US006293413B1

(12) United States Patent
Patton

(10) Patent No.: US 6,293,413 B1
(45) Date of Patent: Sep. 25, 2001

(54) CAP HOLDER

(76) Inventor: Scott A. Patton, 2500 Toron Ct., Alexandria, VA (US) 22306

( * ) Notice: Subject to any disclaimer, the term of this patent is extended or adjusted under 35 U.S.C. 154(b) by 0 days.

(21) Appl. No.: 09/395,932

(22) Filed: Sep. 14, 1999

(51) Int. Cl.[7] ..... A47F 7/06; A47G 25/10
(52) U.S. Cl. ..... 211/32; 211/181.1
(58) Field of Search ..... 211/30–32, 181.1; 248/309.1, 316.1, 302; 223/84; D6/317, 323

(56) References Cited

U.S. PATENT DOCUMENTS

| | | | | |
|---|---|---|---|---|
| D. 368,168 | * | 3/1996 | Bennett | D6/323 |
| 638,196 | * | 11/1899 | Chester | 211/32 |
| 722,856 | * | 3/1903 | Krezdorn | 211/32 |
| 861,820 | * | 7/1907 | Elliott | 211/32 |
| 1,116,706 | * | 11/1914 | Hutt | 211/32 |
| 1,393,843 | * | 10/1921 | Smith | 211/32 |
| 1,535,515 | * | 4/1925 | Waters et al. | 211/32 |
| 1,572,973 | * | 2/1926 | Tait | 211/32 |
| 1,712,421 | * | 5/1929 | Cowan, Jr. | 211/32 |
| 1,970,943 | * | 8/1934 | Raymond | 211/32 |
| 1,985,961 | * | 1/1935 | Switzer | 211/32 |
| 2,626,712 | | 1/1953 | Frush | 211/32 |
| 2,631,734 | * | 3/1953 | Hartley | 211/32 |
| 2,643,773 | * | 6/1953 | Nicholson | 211/32 |
| 2,659,489 | * | 11/1953 | Searles | 211/32 |
| 2,670,084 | * | 2/1954 | Evans | 211/32 |
| 2,761,644 | * | 9/1956 | Capocci | 211/32 |
| 2,939,585 | * | 6/1960 | Burgin | 211/32 |
| 3,130,835 | * | 4/1964 | Feinman | 211/32 |
| 3,208,597 | * | 9/1965 | Hansen | 211/32 |
| 4,583,646 | * | 4/1986 | Bowman | 211/32 |
| 4,684,096 | * | 8/1987 | Tanaka | 211/32 |
| 4,805,782 | | 2/1989 | Hale et al. | 211/30 |
| 4,893,770 | * | 1/1990 | Bejak et al. | 248/309.1 |
| 5,002,190 | | 3/1991 | Moreland | 211/32 |
| 5,033,660 | * | 7/1991 | Kelly | 211/30 |
| 5,161,719 | | 11/1992 | Otteson et al. | 223/24 |
| 5,169,007 | | 12/1992 | McHendry | 211/32 |
| 5,244,102 | * | 9/1993 | Koenig | 211/32 |
| 5,480,073 | | 1/1996 | LaManna | 223/1 |
| 5,533,652 | | 7/1996 | Levin | 223/84 |
| 5,662,301 | * | 9/1997 | Fard | 248/309.1 |
| 5,685,465 | | 11/1997 | Berardis | 223/84 |

FOREIGN PATENT DOCUMENTS

| | | | | |
|---|---|---|---|---|
| 30599 | * | 4/1931 | (AU) | 211/32 |
| 236612 | * | 7/1925 | (GB) | 211/32 |

* cited by examiner

*Primary Examiner*—Daniel P. Stodola
*Assistant Examiner*—Jennifer E. Novosad
(74) *Attorney, Agent, or Firm*—Welsh & Flaxman LLC

(57) ABSTRACT

A cap holder for supporting the brim of a baseball type cap. The cap holder includes a bracket supporting a cap support member. The cap support member is composed of a substantially continuous frame member defining a substantially U-shaped opening shaped and dimensioned to selectively receive and retain the brim of a cap when bent and positioned through the U-shaped opening.

7 Claims, 2 Drawing Sheets

CAP HOLDER

BACKGROUND OF THE INVENTION

1. Field of the Invention

The invention relates to a cap holder. More particularly, the invention relates to a brim engaging holder for supporting a baseball type cap while also shaping the brim in an ideal manner.

2. Description of the Prior Art

Baseball type caps have recently moved from a functional item worn to keep sun from a wearer's eyes and face, to fashion items worn by almost anyone anywhere. The new fashion status of these caps has created very specific personal styles of how the caps should be worn.

One such personal style for wearing these caps involves the curvature of the cap's brim. For many cap wearers it has become imperative that the cap's brim be bent in a highly specific manner. With this in mind, those concerned with the curvature of their brim will expend substantial effort to maintain the proper curvature in their cap's brim.

Such individuals are forced to resort to spending substantial time manually bending their caps or resort to a variety of available shaping devices. The shaping devices range from rubber banding the brim of a cap about a properly sized soda bottle to a variety of store bought forms upon which the cap's brim may be mounted.

Unfortunately, such store bought forms are commonly difficult to use and require that the cap wearer follow a variety of steps to properly secure the brim of the cap to the forming device. Examples of such devices include, U.S. Pat. No. 4,805,782 to Hale et al., U.S. Pat. No. 5,161,719 to Otteson et al., U.S. Pat. No. 5,480,073 to LaManna, U.S. Pat. No. 5,533,652 to Levin and U.S. Pat. No. 5,685,465 to Berardis.

A review of the prior art shows that a need still exists for a simple and convenient holder which shapes the brim of a cap in a highly specific manner while the cap is supported thereon. The present invention provides such a cap holder.

SUMMARY OF THE INVENTION

It is, therefore, an object of the present invention to provide a cap holder for supporting the brim of a baseball type cap. The cap holder includes a bracket supporting a cap support member. The cap support member is composed of a substantially continuous frame member defining a substantially U-shaped opening shaped and dimensioned to selectively receive and retain the brim of a cap when bent and positioned through the U-shaped opening.

It is also an object of the present invention to provide a cap holder wherein the cap support member further includes means for shaping the cap while it is supported thereby.

It is another object of the present invention to provide a cap holder wherein the cap support member is pivotally secured to the bracket.

It is a further object of the present invention to provide a cap holder wherein the frame member is a substantially rigid wire bent to a desired shape.

It is also an object of the present invention to provide a cap holder wherein the frame member is composed of a large first curvature member having inwardly extending first and second ledges extending from opposite sides of the large first curvature member, the first and second ledges being shaped and dimensioned to support and edge of the brim of the cap as it is placed through the U-shaped opening.

It is another object of the present invention to provide a cap holder wherein the first ledge and the second ledge are substantially U-shaped.

It is a further object of the present invention to provide a cap holder wherein the first ledge includes a free end and the second ledge includes a free end, and the free ends of the first and second ledges are respectively coupled to the bracket to pivotally secure the cap support member to the bracket.

It is also an object of the present invention to provide a cap holder wherein the large first curvature member lies in a first plane, and the first and second ledges lie in a second plane oriented at an angle relative to the first plane.

It is another object of the present invention to provide a cap holder wherein the second plane is oriented obliquely relative to the first plane.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
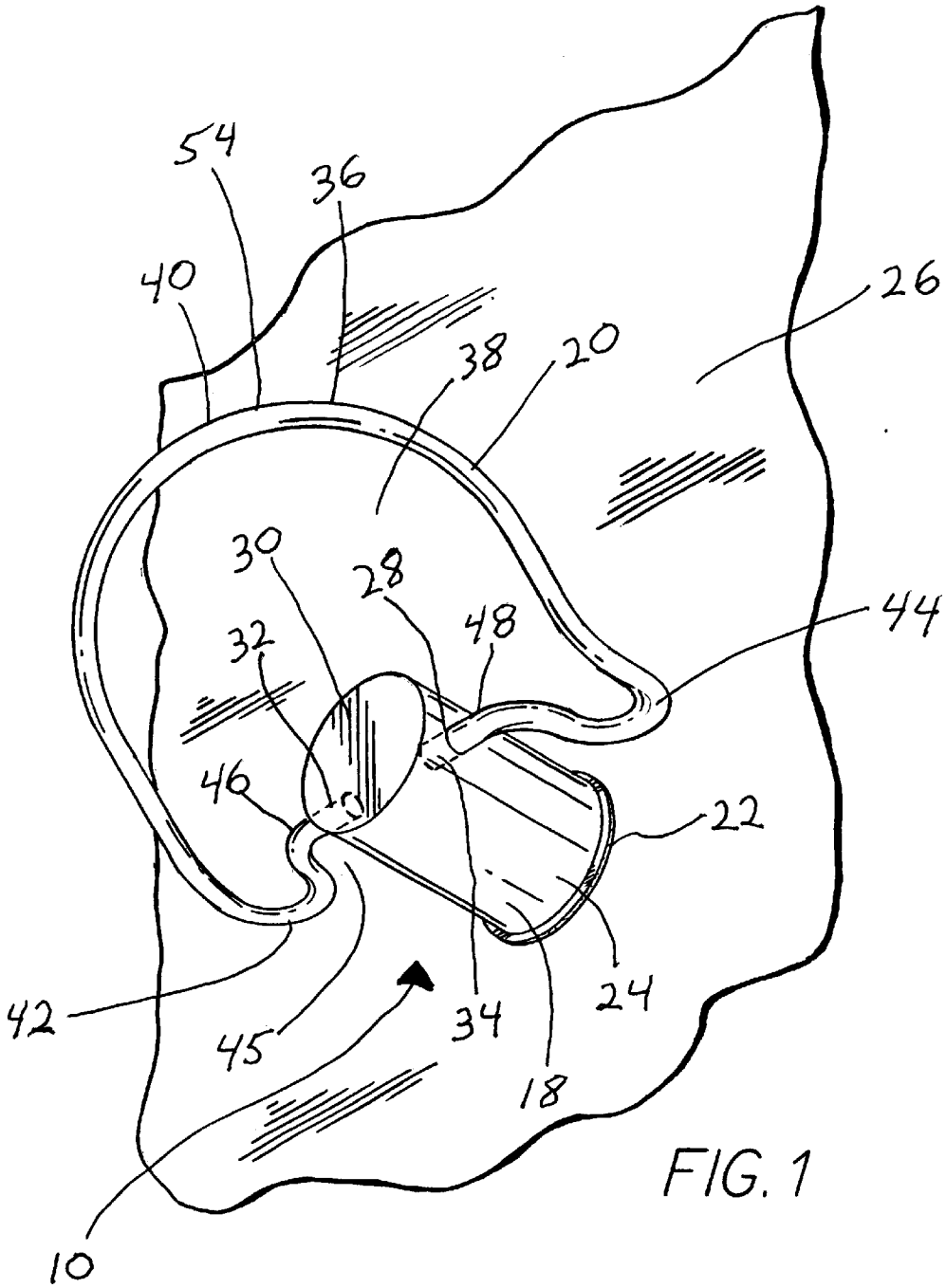
FIG. 1 is a perspective view of the present cap holder.

With reference to FIG. 1, a cap holder 10 is disclosed. The cap holder 10 is particularly designed for engaging and supporting the brim 12 of a baseball type cap 14, although the cap holder 10 may be adapted to support a wide variety caps and hats without departing from the spirit of the present invention.

As those skilled in the art well appreciate, baseball type caps 14 are commonly formed with a crown 16 to which a forward extending brim 12 is secured. While the crown 16 is commonly formed from a substantially flexible fabric, the brim 12 is formed to maintain its shape. With this in mind, the brim 12 is commonly formed with a relatively rigid substrate covered with selected materials coordinating with the material of the crown 16. The substrate is designed to permit flexing and shaping of the brim 12 in a manner allowing the wearer to tailor the brim 12 to suit his or her specific desires.

The present cap holder 10 is designed to support a cap 14 by receiving and retaining the brim 12 of the cap 14. Specifically, the cap holder 10 includes a bracket 18 pivotally supporting a cap support member 20. In accordance the preferred embodiment of the present invention, the bracket 18 is a substantially cylindrical member with a support surface attachment member 22 coupled to a first end 24 of the bracket 18. The support surface attachment member 22 is an adhesive pad with a release strip secured to its exposed surface. As such, when one wishes to mount the present cap holder 10 on a specific support surface 26, the release strip is simply removed and the bracket 18 is adhesively secured to the support surface 26.

The bracket 18 further includes a pivot hole 28 adjacent the second end 30 of the bracket 18. The pivot hole 28 is shaped and dimensioned to facilitate attachment of the cap support member 20 to the bracket 18 by inserting opposite ends 32, 34 of the cap support member 20 into opposite sides of the pivot hole 28.

The cap support member 20 is composed of a substantially continuous frame member 36 defining a substantially U-shaped opening 38 shaped and dimensioned to selectively receive and retain the brim 12 of a cap 14 such that the cap support member 20 supports the cap 14 while also bending the brim 12 in a highly specific manner. In accordance with the preferred embodiment of the present invention, the frame member 36 is formed from a piece of heavy gauge metal wire which is bent to the desired shaped. Attachment of the frame member 36 to the pivot hole 28 of the bracket 18 is facilitated by creating the frame member 36 with first and second free ends 32, 34. In this way, the first and second free ends 32, 34 of the frame member 36 are inserted within the pivot hole 28 to create a pivotal connection between the bracket 18 and the cap support member 20.

While the preferred embodiment of the present invention employs a metal frame member bent to a desired shape, the cap support member may be formed from a variety of materials using a variety of techniques without departing from the spirit of the present invention.

As discussed above, the cap support member 20 defines a substantially U-shaped opening 38 to receive and support the brim 12 of a cap 14. More specifically, the frame member 36 which defines the U-shaped opening 38 includes a large first curvature member 40 having a closed end 54 which extends away from the bracket. The frame member 36 further includes first and second U-shaped ledges 42, 44 extending from opposite ends of the large first curvature member 40. The first and second ledges 42, 44 extend from the large first curvature member 40 inwardly toward, and cooperate with, the bracket 18 to close off the open end 45 of the U-shaped opening 38.

In accordance with the preferred embodiment of the present invention, the first and second ledges 42, 44 are substantially U-shaped members extending inwardly with respect to the concave surface defined by the large first curvature member 40. Each of the first and second ledges 42, 44 include a free end 46, 48 which extends within the pivot hole 28 to pivotally couple the cap support member 20 to the bracket 18.

In this way, the large first curvature member 40 and the first and second ledges 42, 44 define the substantially U-shaped opening 38 for receiving and retaining the brim 12 of a cap 14 therein. With this in mind, the large first curvature member 40 provides a surface which engages the upper surface 50 of the brim 12, while the edges 52 of the brim 12 sit upon the first and second ledges 42, 44. Proper positioning of the first and second ledges 42, 44 relative to the edges 52 of the brim 12 is facilitated by obliquely orienting the first and second ledges 42, 44 relative to the large first curvature member 40. Specifically, the large first curvature member 40 lies in a first plane and the first and second ledges 42, 44 lie in a second plane which is oriented at an angle relative to the first plane.

By configuring the cap support member 20 in this way, the brim 12 of a cap 14 may be inserted within the U-shaped opening 38 and retained therein. Specifically, the brim 12 of a cap 14 is first bent along its center portion and inserted within the opening 38 (see FIG. 2). As the brim 12 is inserted, its outward resilience forces the upper surface 50 of the brim 12 into engagement with the large first curvature member 40. The brim 12 is further inserted until the edges 52 of the brim 12 contact the first and second ledges 42, 44 and the brim 12 may no longer be moved within the U-shaped opening 38.

Figure 3:
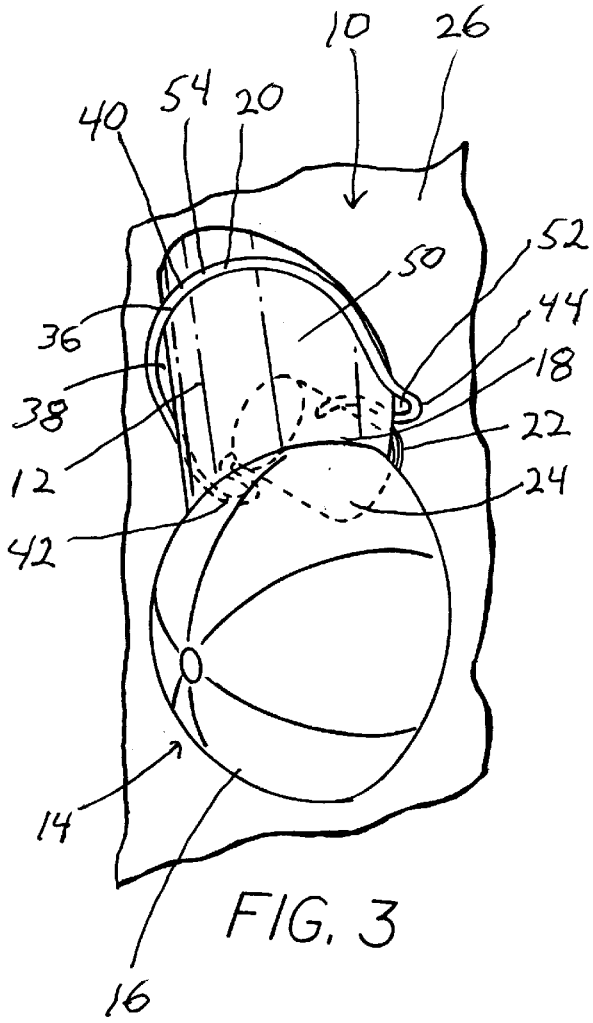

When the brim 12 reaches this point, it becomes trapped between the large first curvature member 40 and the first and second ledges 42, 44 when released (see FIG. 3). The outward resilience of the brim 12 pressing against the large first curvature member 40 and portions of the first and second ledges 42, 44 creates a relatively secure connection. The pressure created between the brim 12 and the large first curvature member 40 creates a friction fit which retains the brim 12, and cap 14, within the cap support member 20. When the cap 14 is released, its weight acts upon the pivotally mounted cap support member 20 to rotate the cap 14 downwardly to a final support position as shown in FIG. 3. The cap 14 will remain in this position until the wearer removes the cap 14 from the cap support member 20.

The shape of the large first curvature member 40, in combination with the control provided by the support of the first and second ledges 42, 44 along the edges 52 of brim 12, further shapes the brim 12 in a highly controlled manner while the cap 14 is retained within the present cap holder 10. Specifically, as the brim 12 is retained within the cap holder 10, the cap support member 20 acts upon the substrate of the brim 12 to impart shape, such that the brim 12 will retain a specific shape when it is removed from the cap holder 10.

Figure 2:
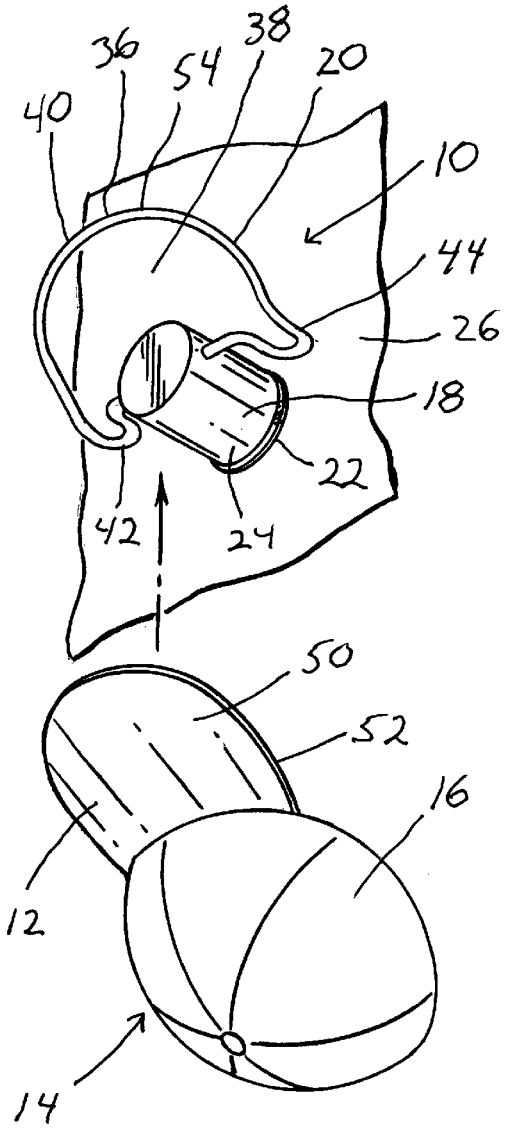
FIGS. 2 and 3 show the steps used to insert a cap within the present cap holder.

With reference to FIGS. 1–3, the bracket 18 is mounted to a vertical wall 26 by simply attaching the first end 24 of the bracket 18 to the wall 26 with the aid of the adhesive member 22. The bracket 18 should be mounted such that the first and second ledges 42, 44 extend toward the wall when the closed end 54 of the large first curvature member 40 faces upwardly. It is contemplated that the most convenient manner for inserting a cap 14 when the cap holder 10 is mounted as discussed above is to first rotate the cap support member 20 such that the closed end 54 of the U-shaped opening 38 faces upwardly.

The pivotal attachment of the cap support member 20 to the bracket 18 allows for attachment of the present cap holder 10 to the back of a door, for example, such that when the door is abruptly closed the cap holder 10 can pivot away from the door while retaining the cap 14. The cap support member 20 may be coated in plastic to increase frictional resistance between the brim 12 and itself. In addition, the plastic coating will prevent the discoloration of a wet cap.

While the preferred embodiments have been shown and described, it will be understood that there is no intent to limit. the invention by such disclosure, but rather, is intended to cover all modifications and alternate constructions falling within the spirit and scope of the invention as defined in the appended claims.

What is claimed is:

1. A cap holder for supporting the brim of a baseball type cap, comprising:

a bracket supporting a cap support member;

the cap support member is composed of a substantially continuous frame member, defined by a substantially rigid wire bent to a desired shape, and defining a substantially U-shaped opening shaped and dimensioned to selectively receive and retain the brim of a cap when bent and positioned through the U-shaped opening, and wherein the frame member is composed of a first large curvature member having inwardly extending first and second ledges extending from opposite sides of the first large curvature member, the first and second ledges being shaped and dimensioned to support the edge of the brim of the cap as it is placed through the U-shaped opening.

2. The cap according to claim 1, wherein the cap support member further includes means for shaping the cap while it is supported thereby.

3. The cap according to claim 1, wherein the first ledge and the second ledge are substantially U-shaped.

4. The cap according to claim 1, wherein the first ledge includes a free end and the second ledge includes a free end, and the free ends of the first and second ledges are respectively coupled to the bracket to pivotally secure the cap support member to the bracket.

5. A cap holder for supporting the brim of a baseball type cap, comprising:

a bracket supporting a cap support member;

the cap support member is composed of a substantially continuous frame member defining a substantially U-shaped opening and dimensioned to selectively receive and retain the brim of a cap when bent and positioned through the U-shaped opening, and wherein the frame member is composed of a first large curvature member having inwardly extending first and second ledges extending from opposite sides of the first large curvature member, the first and second ledges being shaped and dimensioned to support the edge of the brim of the cap as it is placed through the U-shaped opening, wherein the first large curvature member lies in a first plane, and the first and second ledges lie in a second plane oriented at an angle relative to the first plane.

6. The cap according to claim 5, wherein the second plane is oriented obliquely relative to the first plane.

7. A cap holder for supporting the brim of a baseball type cap, comprising:

a bracket supporting a cap support member;

the cap support member is composed of a substantially continuous frame member defining a substantially U-shaped opening and dimensioned to selectively receive and retain the brim of a cap when bent and positioned through the U-shaped opening, and wherein the frame member is composed of a first large curvature member having inwardly extending first and second ledges extending from opposite sides of the first large curvature member, the first and second ledges being shaped and dimensioned to support the edge of the brim of the cap as it is placed through the U-shaped opening, wherein the cap support member is pivotally secured to the bracket.

* * * * *